US011564508B2

(12) United States Patent
Rosilier

(10) Patent No.: US 11,564,508 B2
(45) Date of Patent: Jan. 31, 2023

(54) PHONE CASE WALL DISPLAY AND ORGANIZER

(71) Applicant: ABBYROSE, LLC, San Antonio, TX (US)

(72) Inventor: Zach Rosilier, Boulder, CO (US)

(73) Assignee: ABBYROSE, LLC, San Antonio, TX (US)

( * ) Notice: Subject to any disclaimer, the term of this patent is extended or adjusted under 35 U.S.C. 154(b) by 0 days.

(21) Appl. No.: 17/191,219

(22) Filed: Mar. 3, 2021

(65) Prior Publication Data

US 2022/0279942 A1 Sep. 8, 2022

(51) Int. Cl.

| | |
|---|---|
| ***A47F 5/00*** | (2006.01) |
| ***A45C 11/00*** | (2006.01) |
| ***A45C 13/00*** | (2006.01) |
| ***A47F 7/03*** | (2006.01) |
| ***A47F 7/024*** | (2006.01) |
| ***A47F 5/08*** | (2006.01) |
| ***A47F 3/00*** | (2006.01) |

(Continued)

(52) U.S. Cl.

CPC ..... *A47F 5/0018* (2013.01); *A45C 11/00* (2013.01); *A45C 13/002* (2013.01); *A47F 3/002* (2013.01); *A47F 5/0006* (2013.01); *A47F 5/0815* (2013.01); *A47F 5/0876* (2013.01); *A47F 7/0042* (2013.01); *A47F 7/0246* (2013.01); *A47F 7/03* (2013.01); *A47F 7/143* (2013.01); *A45C 2011/002* (2013.01)

(58) Field of Classification Search

CPC .... A47F 5/0018; A47F 5/0006; A47F 5/0876; A47F 5/08; A47F 5/0815; A47F 5/0084; A47F 7/0042; A47F 7/03; A47F 7/143; A47F 3/002; A47F 3/007; A47F 7/024; A47F 7/0246; A47F 5/0884; A47G 29/10; A47G 29/00; A47G 29/08; A45C 11/00; A45C 2011/002; G09F 7/18; G09F 1/10; G09F 7/00; G09F 7/08

USPC ..... 211/119.012, 26.1, 26.2, 85.2, 85.9, 61, 211/106.01, 13.1; 248/690, 692, 489, 248/490; 206/37.1, 6.1, 495; 40/657, 40/617, 618, 622, 124.4

See application file for complete search history.

(56) References Cited

U.S. PATENT DOCUMENTS 791,912 A * 6/1905 Jackson ..... A47G 29/10 206/483

805,378 A * 11/1905 Newman ..... G09F 3/00 211/10

(Continued)

*Primary Examiner* — Jennifer E. Novosad

(74) *Attorney, Agent, or Firm* — Innovation Capital Law Group, LLP; Vic Lin

(57) ABSTRACT

A phone case display and organizer can display multiple mobile phone cases so a user can see the design on the back of the cases. The display case and organizer provides a solution for the clutter of multiple phone cases in a decorative and organized way such that the design is visible, and the individual cases are easily accessible for the customer to choose from and use. Typically, phone cases can get damaged when stacked or crowded into small spaces. The display and organizer provides ample room to display the cases in a way that does not damage them while allowing the consumer to see the entire collection side by side in order to use them as fashion accessories. Having the cases displayed out in the open rather that stacked in a drawer allows the consumer to enjoy their collection and remember to use them regularly.

6 Claims, 6 Drawing Sheets

(51) Int. Cl.
*A47F 7/00* (2006.01)
*A47F 7/14* (2006.01)

(56) References Cited

U.S. PATENT DOCUMENTS 1,726,537 A * 9/1929 Carmichael ..... A47F 7/143 40/657
2,347,035 A * 4/1944 Douglas ..... A47G 29/10 40/657
2,954,874 A * 10/1960 Rouse ..... A47G 29/10 248/220.31
3,191,777 A * 6/1965 Willits, Jr. ..... A47F 5/0815 211/106.01
3,442,396 A * 5/1969 Cass ..... A47F 5/0876 248/220.21
4,084,700 A * 4/1978 Dunchock ..... A47F 7/021 248/902
4,326,761 A * 4/1982 Schwartz ..... A47G 29/10 206/580
4,494,661 A * 1/1985 Krusche ..... A47F 5/083 248/220.31
4,573,590 A * 3/1986 Ellis ..... A47F 5/0068 211/85.15
4,771,897 A * 9/1988 Ho ..... A47G 29/10 211/94.01
4,893,777 A * 1/1990 Gassaway ..... E05B 73/0082 211/8
4,938,368 A * 7/1990 Sharman ..... A47F 5/0876 211/85.15
4,986,426 A * 1/1991 Niklaus ..... A47F 7/022 248/116
5,191,972 A * 3/1993 Helzer ..... A47G 1/12 206/0.8
5,341,941 A * 8/1994 Marlor ..... F16M 11/041 211/26.1
5,785,190 A * 7/1998 Otema ..... A47F 5/0823 248/221.12
5,806,692 A * 9/1998 Pepper ..... A47B 96/027 211/70.1
5,911,762 A * 6/1999 Ott ..... A47F 3/002 211/26.1
5,957,421 A * 9/1999 Barbour ..... B25H 3/006 248/314
6,209,734 B1 * 4/2001 Wang ..... D06F 95/004 211/85.15
6,283,278 B1 * 9/2001 Holztrager ..... G09F 7/10 206/495
6,312,067 B1 * 11/2001 Blanchard ..... A01M 31/00 40/657
6,763,779 B1 * 7/2004 Borders ..... G09B 1/00 211/26.1
6,971,527 B2 * 12/2005 Chandaria ..... B65D 75/14 211/13.1
6,997,333 B2 * 2/2006 Howard ..... A47G 29/10 211/85.9
7,000,810 B1 * 2/2006 Farmer ..... B60R 11/06 224/543
7,008,029 B1 * 3/2006 Aclin ..... A47B 67/02 312/227
7,270,309 B2 * 9/2007 Burns ..... F16M 13/02 248/220.21
8,065,828 B2 * 11/2011 Bevers ..... G09F 3/203 40/657
8,302,769 B2 * 11/2012 Justiss ..... A45F 5/02 206/320
8,360,373 B2 * 1/2013 Johnson ..... F16M 11/00 340/568.1
8,448,793 B2 * 5/2013 Barron ..... A47G 29/00 220/507
8,469,204 B1 * 6/2013 Bradshaw ..... F16M 13/00 211/26.1
8,636,183 B1 * 1/2014 Steiner ..... A45C 11/00 224/560
8,706,176 B1 * 4/2014 Jia ..... H04M 1/04 455/575.8
8,931,746 B2 * 1/2015 Fanning, Jr. ..... G09F 5/042 248/220.21
9,241,584 B1 * 1/2016 McHatet ..... A47F 3/14
9,681,718 B1 * 6/2017 Poole ..... F16M 11/041
9,732,784 B2 * 8/2017 Clouser ..... F16B 47/003
9,876,885 B1 * 1/2018 Velasquez ..... H04B 1/3888
9,924,809 B2 * 3/2018 Forrest ..... A47G 1/16
10,059,497 B2 * 8/2018 Rehberg ..... B65D 73/0064
10,075,010 B2 * 9/2018 Rosengren ..... H04B 1/3822
10,405,676 B1 * 9/2019 Underwood ..... F16B 1/00
2002/0130055 A1 * 9/2002 Morrison, Jr. ..... B65D 85/18 206/297
2002/0145365 A1 * 10/2002 Johnson ..... A47F 3/005 312/114
2004/0031901 A1 * 2/2004 Lin ..... B65D 73/00 248/489
2004/0262248 A1 * 12/2004 Howard ..... A47G 29/10 40/657
2005/0040741 A1 * 2/2005 Simmons ..... A47F 3/005 312/245
2005/0098510 A1 * 5/2005 Lom ..... A47F 7/147 211/13.1
2006/0038097 A1 * 2/2006 Diller ..... A61G 13/101 248/225.11
2008/0200221 A1 * 8/2008 Lockwood ..... A47G 29/10 455/575.1
2009/0229089 A1 * 9/2009 Galant ..... A47F 5/16 24/714.8
2010/0037501 A1 * 2/2010 Danielson ..... G09F 21/02 40/625
2010/0229442 A1 * 9/2010 Snow ..... A47G 1/065 40/761
2011/0155875 A1 * 6/2011 Hofman ..... A47G 25/06 248/220.31
2012/0047972 A1 * 3/2012 Grant ..... E05B 47/06 70/77
2013/0170823 A1 * 7/2013 McDonald ..... H04M 1/04 396/428
2013/0292281 A1 * 11/2013 Chung ..... H04B 1/3888 206/320
2013/0341412 A1 * 12/2013 Johnson ..... G06K 19/06187 235/487
2014/0008405 A1 * 1/2014 Beaver ..... B60R 11/0241 224/276
2014/0125454 A1 * 5/2014 De Maria ..... G07C 9/00912 340/5.73
2014/0190221 A1 * 7/2014 Jiang ..... A47G 29/10 206/525
2014/0228082 A1 * 8/2014 Morrow ..... H04B 1/3888 455/575.8
2015/0196151 A1 * 7/2015 Phipps ..... F16M 11/24 211/85.2
2015/0288409 A1 * 10/2015 Forsythe ..... H04B 1/385 455/575.6
2015/0374088 A1 * 12/2015 Kim ..... A45C 11/00 224/576
2016/0150861 A1 * 6/2016 Yao ..... F16M 11/105 224/245
2016/0174746 A1 * 6/2016 Doyle ..... A47G 29/10 211/183
2016/0183392 A1 * 6/2016 Kelley ..... A45F 5/00 211/26
2016/0344437 A1 * 11/2016 Gordon ..... H04M 1/05
2017/0308210 A1 * 10/2017 Brugger ..... G06F 3/0412
2018/0325228 A1 * 11/2018 Leimer ..... A45C 11/182
2020/0154839 A1 * 5/2020 Brown ..... A45C 11/00
2020/0268177 A1 * 8/2020 Pääkkö ..... B25H 5/00
2020/0351396 A1 * 11/2020 Poon ..... H04M 1/04
2020/0395769 A1 * 12/2020 Glazebrook ..... H02J 50/10
2021/0106106 A1 * 4/2021 Reyes ..... F16M 13/022
2021/0384937 A1 * 12/2021 Sharma ..... H04B 1/3888

* cited by examiner

PHONE CASE WALL DISPLAY AND ORGANIZER

BACKGROUND OF THE INVENTION

1. Field of the Invention

Embodiments of the invention relate generally to mobile electronic device accessories. More particularly, embodiments of the invention relate to a wall display and organizer for cases for electronic devices, such as mobile phones, tablets and the like.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Cell phone cases have made the transition from a tech accessory to a fashion accessory, with many people accumulating a collection of phone cases that they switch between regularly, rather than just having one or two. This has created the need for a way to keep cases protected, organized and accessible so that a person can easily pick from their collection to choose which phone case they want to use/wear on a given day.

The only consumer solution for phone cases is to put them a drawer, basket, or storage bin. One problem with this solution is that the cases can become deformed or damaged by being stacked or squished in small spaces or crowded together. This solution is also lacking because it does not allow the person to see the various designs next to each other in order to accessorize an outfit. Finally, putting the cases away in a drawer or basket tends to make the user forget about what they have and not use them. Displaying cases in a way that encourages use creates more consumer satisfaction. The only other solutions for displaying multiple phone cases are in the retail space, with the phone case typically in a box and hanging from a hook. This approach, however, does not transfer to the consumer environment.

SUMMARY OF THE INVENTION

Embodiments of the present invention provide a method for displaying and organizing a plurality of phone cases comprising disposing a plurality of hooks on a back member; and hanging each of the plurality of phone cases on respective ones of the plurality of hooks so that a back side of each of the plurality of phone cases are visible.

Embodiments of the present invention further provide a method for displaying and organizing a plurality of phone cases comprising disposing a plurality of hooks on a back member surrounded by a frame; hanging each of the plurality of phone cases on respective ones of the plurality of hooks so that a back side of each of the plurality of phone cases are visible; and positioning a lip of each of the plurality of phone cases into a depression formed between a top surface of the plurality of hooks and the back member.

Embodiments of the present invention also provide a phone case display and organizer comprising a back member; a frame surrounding the back member; a plurality of hooks on the back member; and a depression formed between a top surface of the plurality of hooks and the back member.

These and other features, aspects and advantages of the present invention will become better understood with reference to the following drawings, description, and claims.

BRIEF DESCRIPTION OF THE DRAWINGS

Some embodiments of the present invention are illustrated as an example and are not limited by the figures of the accompanying drawings, in which like references may indicate similar elements.

Figure 1:
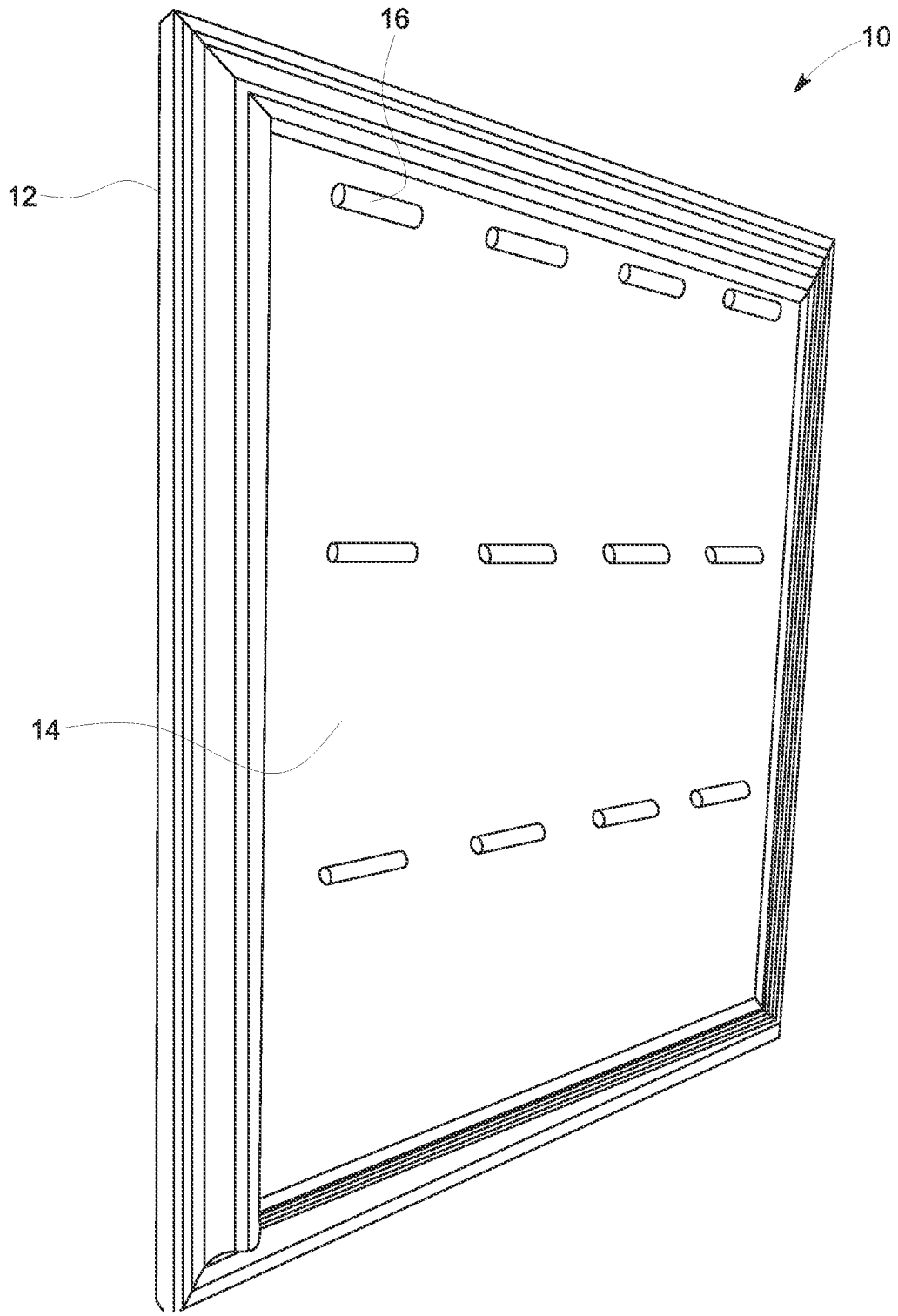
FIG. 1 illustrates a perspective view of a phone case display and organizer according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any apparatus, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a phone case display and organizer that can display multiple mobile phone cases in such a way as to see the design on the back of the cases in a convenient and decorative way that organizes and protects them. The display case and organizer provides a solution for the clutter of multiple phone cases in a decorative and organized way such that the design is visible, and the individual cases are easily accessible for the customer to choose from and use. Typically, phone cases can get damaged when stacked or crowded into small spaces. The display and organizer provides ample room to display the cases in a way that does not damage them while allowing the consumer to see the entire collection side by side in order to use them as fashion accessories. Having the cases displayed out in the open rather than stacked in a drawer allows the consumer to enjoy their collection and remember to use them regularly.

Figure 2:
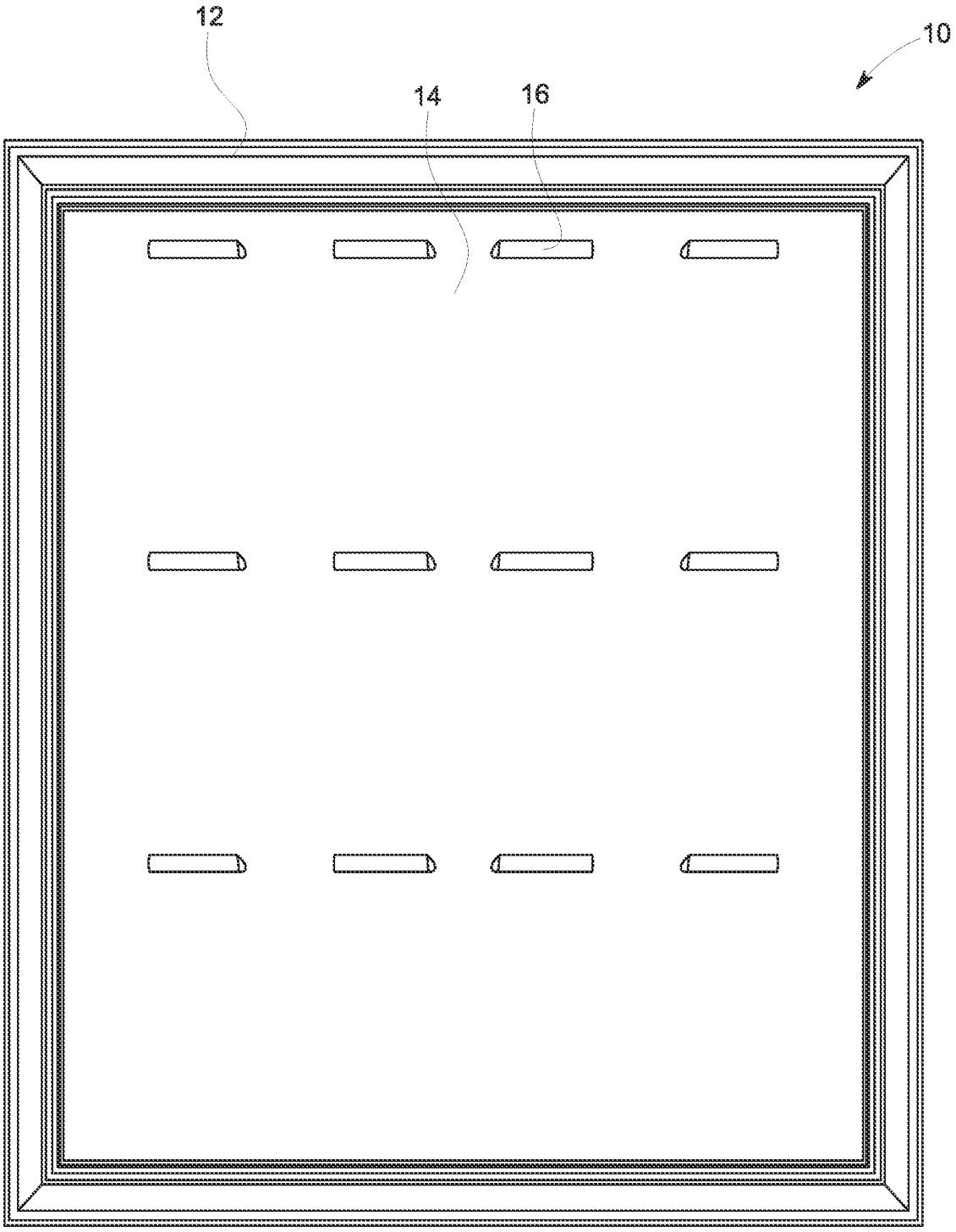
FIG. 2 illustrates a front view of the phone case display and organizer of FIG. 1.

Referring now to FIGS. 1 and 2, a phone case display and organizer 10 (also referred to as display 10, organizer 10, or display and organizer 10) can include an outer frame 12 that retains a back member 14 therewithin. The outer frame 12 can be similar to a picture frame, for example. While the Figures illustrate a rectangular frame, other shapes may be used within the scope of the present invention. The frame 12 may also be excluded from the organizer 10, provided that the back member 14 has sufficient rigidity to hold phone case, as described below.

A plurality of hooks 16 are attached to a front face of the back member 14. The hooks 16 can have various sizes and shapes. The hooks 16 have a length smaller than a width of a phone case to be hung on the hook 16. The hooks 16 may be equally spaced or may be unequally spaced so that the organizer 10 can hold cases of different sizes.

The back side of the back member 14 can include various hanging/displaying options as may be known in the art. For example, one or more eyes or saw-tooth bars may be disposed on the back side of the back member 14 or on the back side of the frame 12, for example. In some embodiments, a stand may be integrated into the back side of the back member 14, where the stand may be deployed to rest the organizer 10 on a surface, such as a dresser or nightstand, at an angle. Such stands are often employed by picture frames, for example.

Figure 5:
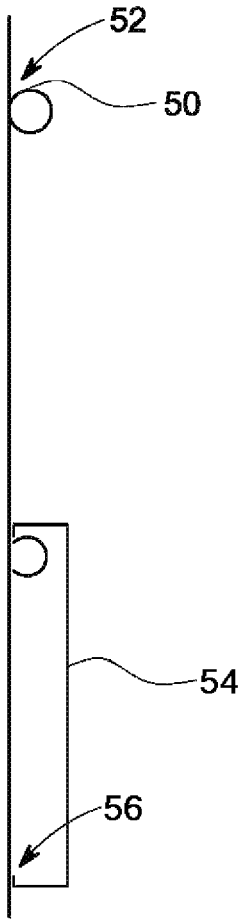
FIG. 5 illustrates a cross-sectional view taken along line V-V of FIG. 3.

As shown in FIG. 5, the hooks can have a round cross section, where a depression 52 is formed where the hook attaches to the back member. The depression 52 may be lower than a top 50 of the hook. A phone case 54 typically includes a lip 54 for retaining the phone case 54 on a phone. The lip 54 can fit into the depression 52 to prevent inadvertent removal of the phone case 54 from the organizer 10.

Figure 3:
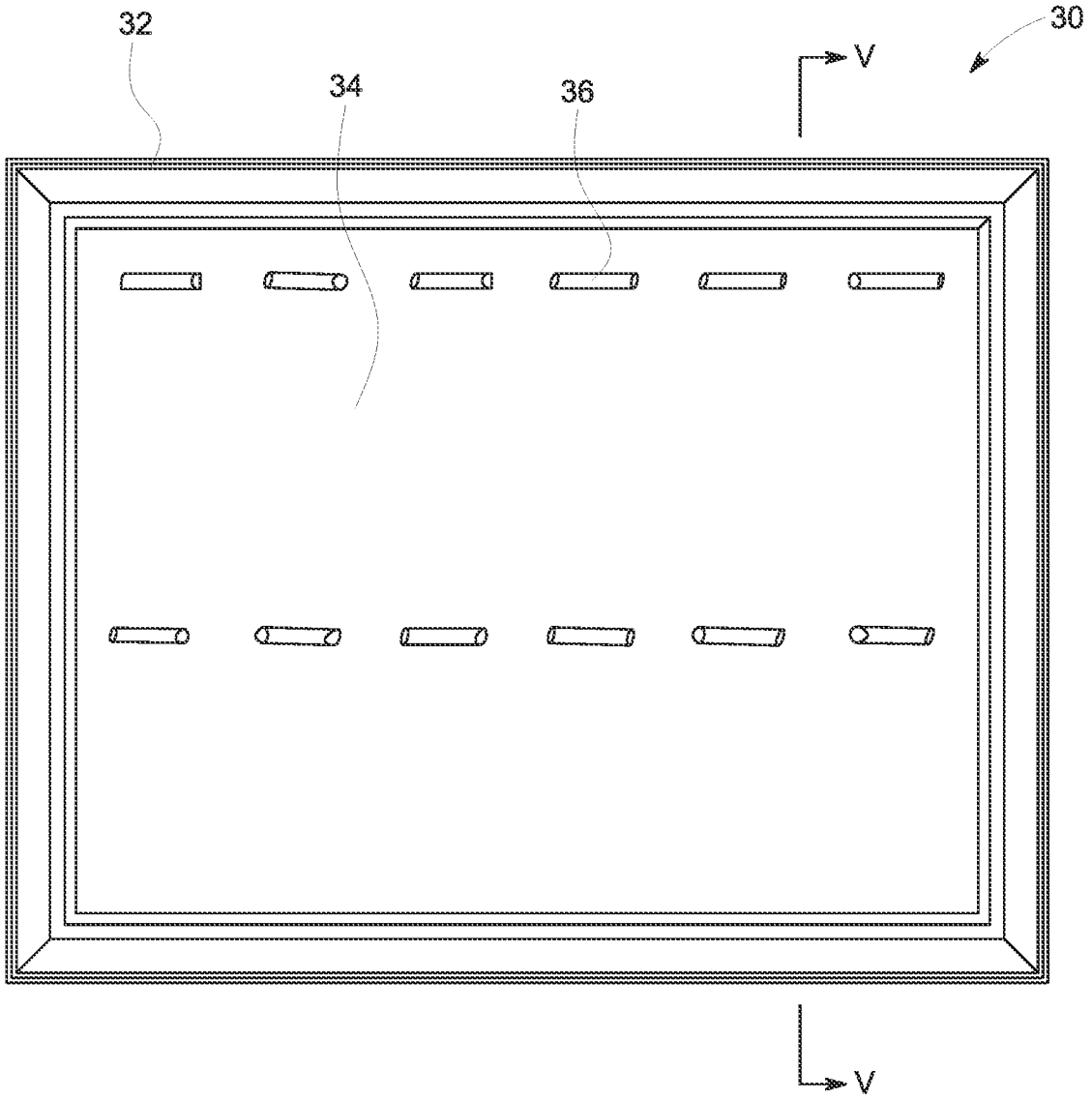
FIG. 3 illustrates an alternate arrangement of a phone case display and organizer according to an exemplary embodiment of the present invention.

Referring to FIG. 3, an organizer 30 can be formed in a landscape format. While FIGS. 1 and 3 provide two different arrangements for organizers 10, 30, it should be understood that other arrangements may be used within the scope of the present invention. The organizer 30 can include a frame 32, a back member 34 and a plurality of hooks 36, similar to that described above with respect to FIGS. 1 and 2.

Figure 4:
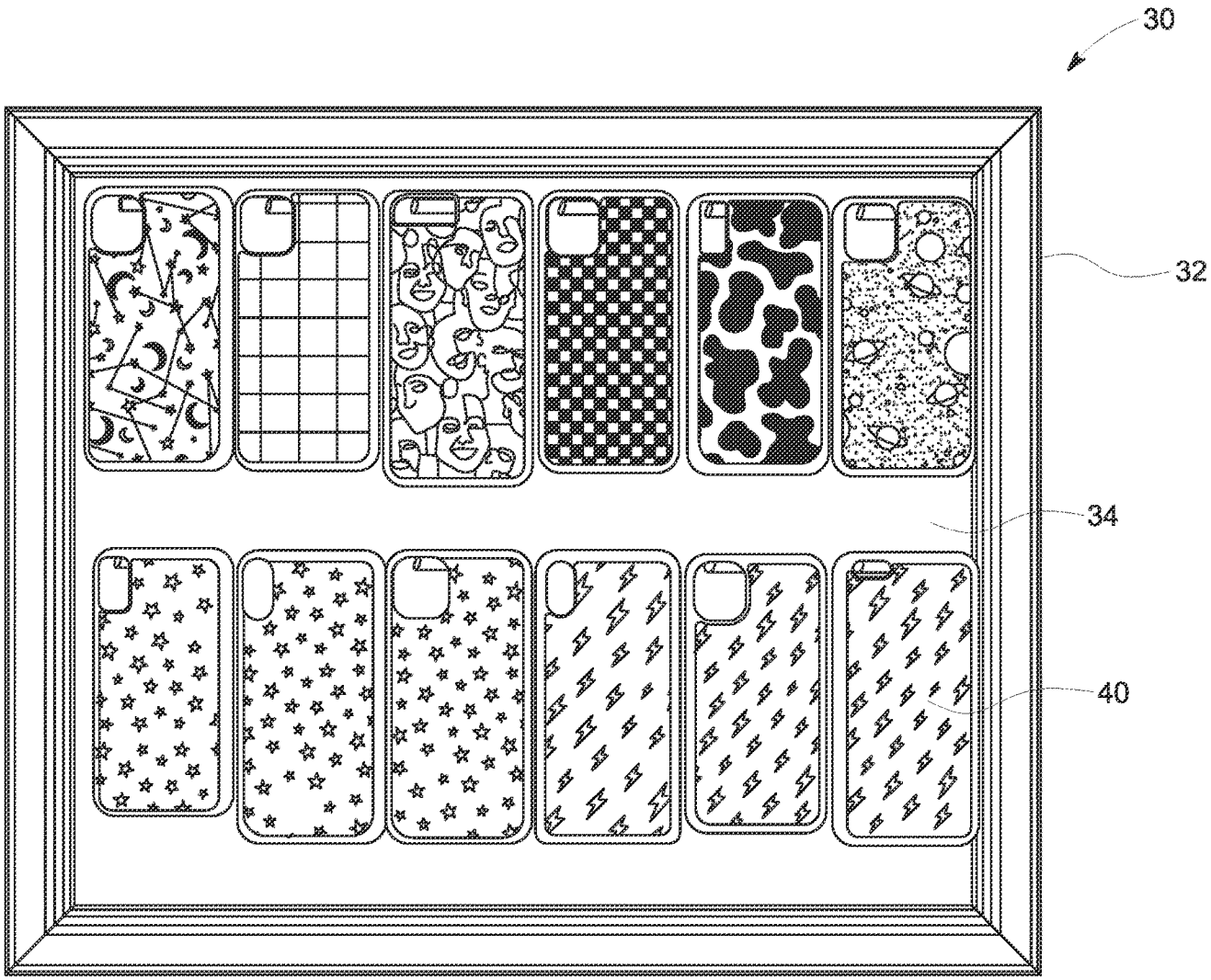
FIG. 4 illustrates a plurality of phone cases displayed on the phone case display and organizer of FIG. 3.

FIG. 4 shows the organizer 30 of FIG. 3 having a plurality of phone cases 40 displayed thereupon. As can be seen, a user can readily see the back sides of the phone cases 40 and can easily choose a phone case based on the user's mood, outfit, or the like.

While the Figures show the phone cases hanging vertically, the organizer may be designed to hold phone cases horizontally as well. Further, while a single hook is illustrated for each phone case, in some embodiments, two hooks may be used to retain each of the phone cases on the organizer.

While the Figures show the organizer assembled, in some embodiments, a kit can be provided that includes the back member, optional frame, a plurality of hooks, and a mounting mechanism for attaching the hooks on the back member. The mounting mechanism can include glue, epoxy, a hook and slot design, hook and loop fastener, or the like. In some embodiments, the hooks may include one or more magnets (or be formed from a magnetic material) and the back member may be formed of a magnetically attractive material. This design can permit the user to attach the hooks on the back member at a desired spacing based on the cases they own, including cases for phones, tablets, and the like.

While the size and shape of the organizer can vary, typically the organizer can be sized to hold at least 8 or more, often at least 12 or more, phone cases. While multiple rows and columns are shown, various configurations may be used, including single rows or columns, offset rows or columns or the like. While the figures show a single case on each hook, in some embodiments, multiple cases may be stacked on one hook, such as a smaller case nested inside a larger case, for example.

Figure 6:
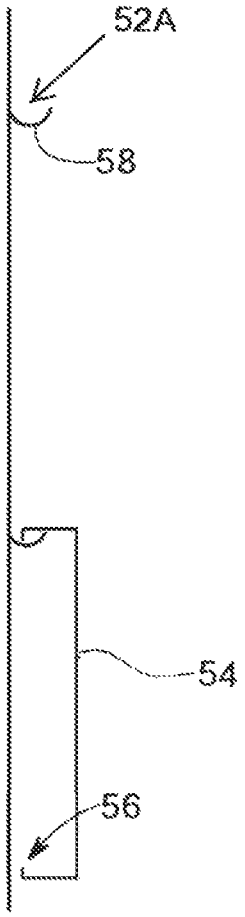
FIG. 6 illustrates another exemplary hook configuration for a phone case display and organizer according to an exemplary embodiment of the present invention.

In some embodiments, as shown in FIG. 6, a hook 58 can be designed as a hollow arc, where the lip 56 of the phone case 54 can fit in a depression 52A formed by the hook itself, behind the raised distal end of the arc. While FIG. 6 shows a rounded arc shape, the shape could be hook shaped, where the distal end of the arc curves around to point toward the back member of the organizer. The hook 58 can cause the inside edge of the phone case to be disposed closer to the hook such that the hook is not visible through the camera/light opening of the phone case. As can be seen in FIG. 6, the hook 58, as well as the hook 50 of FIG. 5, may be formed having a continuous, constant radius of curvature arc shape, where this arc shape can be seen as a cross-section taken along a plane perpendicular to a length of the hook.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A method for displaying and organizing a plurality of phone cases, comprising:

disposing a plurality of hooks on a back member surrounded by a frame;

hanging each of the plurality of phone cases on respective ones of the plurality of hooks so that a back side of each of the plurality of phone cases are visible; and positioning a lip of each of the plurality of phone cases into a depression; and supporting a length of the lip of each of the plurality of phone cases along a hook length of respective ones of the plurality of hooks, wherein a cross-sectional shape of each of the plurality of hooks, taken along a plane perpendicular to the hook length, is an arc shape having a continuous, constant radius of curvature;

each of the plurality of hooks extend, along its hook length, in a fixed position, parallel to the back member; and the depression either is formed between a top surface of each of the plurality of hooks and the back member, or the depression is formed along an inside surface of the arc shape of each of the plurality of hooks and each cross-sectional shape of the plurality of hooks is an open loop.

2. The method of claim 1, wherein the depression is formed between the top surface of each of the plurality of hooks and the back member.

3. The method of claim 1, wherein the plurality of hooks are formed in the open loop, with a distal end of the open loop disposed at a height greater than a lowermost portion of the open loop thus forming the depression between the distal end and the back member.

4. The method of claim 1, wherein at least 8 hooks are disposed on the back member for displaying at least 8 phone cases thereupon.

5. The method of claim 1, wherein the hooks are equally spaced apart in two or more rows on the back member.

6. The method of claim 1, further comprising assembling the hooks on the back member at a desired spacing to permit each hook to support a respective phone case.

* * * * *